US008032971B2

(12) United States Patent
Moskovich

(10) Patent No.: US 8,032,971 B2
(45) Date of Patent: Oct. 11, 2011

(54) ORAL CARE IMPLEMENT HAVING TOOTH WHITENING ELEMENTS

(75) Inventor: Robert A. Moskovich, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 998 days.

(21) Appl. No.: 11/678,231

(22) Filed: Feb. 23, 2007

(65) Prior Publication Data

US 2008/0201885 A1 Aug. 28, 2008

(51) Int. Cl.
*A46B 9/04* (2006.01)

(52) U.S. Cl. ..... 15/167.1; 15/110; 15/DIG. 5

(58) Field of Classification Search ..... 15/110, 15/167.1, DIG. 5
See application file for complete search history.

(56) References Cited

U.S. PATENT DOCUMENTS

| | | | | |
|---|---|---|---|---|
| 1,910,414 | A * | 5/1933 | Varga | 15/188 |
| 5,987,688 | A | 11/1999 | Roberts et al. | |
| 6,041,467 | A | 3/2000 | Roberts et al. | |
| 6,513,182 | B1 | 2/2003 | Calabrese et al. | |
| 6,725,493 | B2 | 4/2004 | Calabrese et al. | |
| 6,779,851 | B2 | 8/2004 | Bouchiere | |
| 6,805,557 | B2 | 10/2004 | Davies et al. | |
| 6,957,469 | B2 | 10/2005 | Davies | |
| 6,966,093 | B2 | 11/2005 | Eliav et al. | |
| 7,434,288 | B2 * | 10/2008 | Gavney, Jr. | 15/117 |
| 2002/0004964 | A1 | 1/2002 | Luchino et al. | |
| 2003/0033680 | A1 | 2/2003 | Davies et al. | |
| 2003/0229959 | A1 | 12/2003 | Gavney | |
| 2004/0060135 | A1 | 4/2004 | Gatzemeyer et al. | |
| 2004/0060136 | A1 | 4/2004 | Gatzemeyer et al. | |
| 2004/0074031 | A1 | 4/2004 | Davies et al. | |
| 2004/0117934 | A1 | 6/2004 | Pfenniger | |
| 2004/0200016 | A1 | 10/2004 | Chan et al. | |
| 2004/0255416 | A1 | 12/2004 | Hohlbein | |
| 2005/0091773 | A1 * | 5/2005 | Gavney et al. | 15/117 |
| 2005/0166342 | A1 | 8/2005 | Hohlbein | |
| 2006/0059642 | A1 | 3/2006 | Solanki | |
| 2006/0064827 | A1 | 3/2006 | Chan | |
| 2006/0236477 | A1 * | 10/2006 | Gavney, Jr. | 15/97.1 |
| 2006/0236478 | A1 | 10/2006 | Hohlbein | |

FOREIGN PATENT DOCUMENTS

| | | | |
|---|---|---|---|
| WO | 0121036 | A | 3/2001 |
| WO | WO2004/021914 | | 3/2004 |
| WO | 2004028293 | A | 4/2004 |
| WO | 2007011758 | A | 1/2007 |

OTHER PUBLICATIONS

International Search Report Dated Jun. 26, 2008.
Official Action, Patent Office of the Russian Federation, for corresponding Russian Application No. 2009135388, dated Sep. 13, 2010.

* cited by examiner

*Primary Examiner* — Randall Chin
(74) *Attorney, Agent, or Firm* — Judy W. Chung

(57) ABSTRACT

An oral care implement or toothbrush includes a head and a tooth cleaning element for enhanced cleaning and whitening of the teeth. The tooth cleaning element has a base corrected to the head. The base has structure in the form of a concave surface facing a distal region of the head such that dentifrice applied to the head is adapted to be directed towards the distal region of the head. A protrusion extends from the concave surface towards the distal region of the head. The head may include a plurality of concave surfaces that are substantially aligned along a longitudinal axis of the head, and protrusion extends from the curved surface.

31 Claims, 3 Drawing Sheets

ORAL CARE IMPLEMENT HAVING TOOTH WHITENING ELEMENTS

FIELD OF THE INVENTION

The present invention pertains to a toothbrush with an enhanced cleaning head.

BACKGROUND OF THE INVENTION

A toothbrush is used to clean teeth by removing plaque and debris from surfaces of the teeth as well to clean gum tissue surrounding teeth. Conventional toothbrushes typically have a head having tufts of bristles and may also have other types of cleaning structures. While toothbrushes according to the prior art provide a number of advantageous features, they nevertheless have certain limitations. For example, certain toothbrushes have a limited ability to retain dentifrice on the head for cleaning the teeth. During the brushing process, the dentifrice typically slips through the tufts of bristles and away from the contact between the bristles and the teeth. As a result, the dentifrice often is spread around the mouth, rather than being concentrated on the contact of the bristles with the teeth. Therefore, the efficiency of the cleaning process is reduced. The present invention seeks to overcome certain of these limitations and other drawbacks of the prior art, and to provide new features not heretofore available.

BRIEF SUMMARY OF THE INVENTION

The invention pertains to an oral care implement or toothbrush with a configuration of cleaning elements to provide enhanced cleaning of teeth.

In one aspect of the invention, an oral care implement has a head and a tooth cleaning element including a base connected to the head wherein the base has structure such that dentifrice applied to the head is adapted to be directed towards a distal region of the head.

In one aspect of the invention, the structure of the base includes an element that extends towards the distal region. The structure of the base may comprise a concave surface facing the distal region.

In another aspect, the base may also include a plurality of concave surfaces facing the distal region and positioned along the base.

In yet another aspect, the concave surfaces of the base may be substantially aligned along a longitudinal axis of the head. The longitudinal ends of the concave surfaces may be adjacent one another.

In another aspect, the base further has a protrusion extending from the concave surface towards the distal region.

In another aspect, the protrusion extends from the concave surface at a lowermost segment of the concave surface. The protrusion and concave surface may comprise a flexible material.

According to another aspect, an arcuate wall extends from the base. In this aspect, the base may have a plurality of arcuate walls positioned along a longitudinal axis.

In another aspect, the arcuate wall has a protuberance extending therefrom. The protuberance is positioned at a generally central location on the arcuate wall. A first arcuate wall extends from the base at one end of the concave surface of the protrusion and a second arcuate wall extending from the base and is spaced from the first arcuate wall at an opposite end of the concave surface. In one aspect, the protrusion is positioned between the first arcuate wall and the second arcuate wall wherein gaps are defined between the protrusion and the arcuate walls.

According to yet another aspect of the invention, the tooth cleaning elements with concave surfaces are positioned at a central location of the base. The concave surfaces are substantially aligned along a longitudinal axis of the head.

Other features and advantages of the invention will become apparent from the following description taken in conjunction with the following drawings.

DETAILED DESCRIPTION OF THE INVENTION

Figure 1:
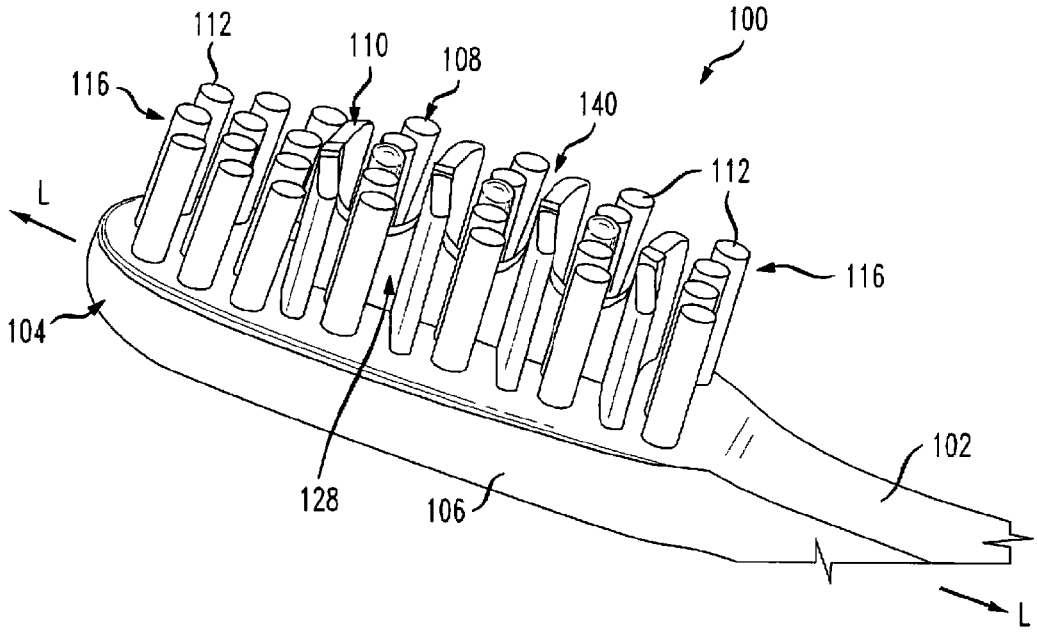
FIG. 1 is a perspective view of a toothbrush according to one or more aspects of an illustrative embodiment, a handle of the toothbrush being partially shown.

In the following description, the invention is discussed in terms of a toothbrush, but could be in the form of other oral care implements including simply a tissue cleansing implement. Further, it is understood that other embodiments may be utilized and structural and functional modifications may be made without departing from the scope of the present invention.

FIGS. 1-5 illustrate an oral care implement, or toothbrush, of the present invention, generally designated with the reference numeral 100. The toothbrush 100 generally includes a handle 102 and a head 104. The toothbrush 100 generally has a longitudinal axis L.

The handle 102 is generally an elongated member that is dimensioned for the user to readily grip and manipulate the toothbrush 100. The handle 102 may be formed of many different shapes, lengths and with a variety of constructions. The handle 102 may have a neck portion directly adjacent to the head 104. In one construction, the handle 102 is integrally formed with the head 104 although other attachment configurations are possible.

Figure 5:
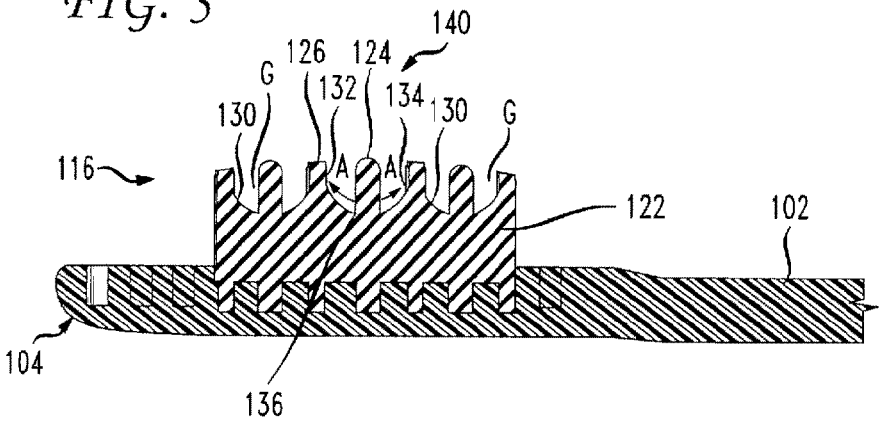
FIG. 5 is a cross-sectional of the toothbrush of FIG. 2 taken along lines 5-5 of FIG. 4.

The head 104 generally includes a support member 106, a first tooth cleaning element 108, and a second tooth cleaning element 110. The support member 106 is typically integrally formed with the handle 102 and supports the tooth cleaning elements 108,110. The tooth cleaning elements 108,110 may be considered to be connected to the head 104. In one embodiment, the first tooth cleaning element 108 is formed from a plurality of bristles 112 (FIG. 1). While FIG. 1 shows the first tooth cleaning element 108 as bristles having a larger diameter, it is understood that the bristles 112 may be in the form of tufts of bristles 112 wherein the bristles 112 have substantially smaller diameters. Other configurations of the bristles 112 are also possible as are known. The bristles 112 extend from the head 104 and are positioned about the second tooth cleaning element 110. As shown in FIG. 1, both the first tooth cleaning element 108 and the second tooth cleaning element 110 extend from the support member 106 and have distal ends that generally define a distal region 116 of the head 104. It is understood that the respective lengths of the first tooth cleaning element 108 and the second tooth cleaning element 110 can both independently vary as desired. The tooth cleaning elements 108,110 can be attached to the support member 106 by known methods, such as being fit within recesses formed in the support member 106 (FIG. 5).

It is understood that the bristles 112 are preferably made from nylon although other materials could be used. The bristles 112 also preferably have a generally circular cross-sectional shape, but could have other cross-sectional shapes as well. The diameter of the bristles 112 can vary depending on the desired cleaning action of the bristles 112.

FIGS. 2-5 further show the second tooth cleaning element 110. The bristles 112 have been removed from FIGS. 2-5 for clarity in describing the second tooth cleaning element 110. The second tooth cleaning element 110 is connected to the head 104 and extends from the head 104. The second tooth cleaning element 110 has structure 118, generally in the form of an element 120 that extends towards the distal region 116. The element 120 can take a variety of forms that extend toward the distal region 116. As explained in greater detail below, the structure 118 allows the toothbrush 100 to better retain and direct dentifrice applied to the head 104 towards the distal region 116 to enhance the whitening and cleaning characteristics of the toothbrush 100. In a preferred construction of toothbrush 100, the second tooth cleaning element 110 is a thermoplastic elastomer member (TPE). In such a construction, the TPE may have varying durometers. For example, to provide comfort as well as cleaning benefits, the elastomeric material has a hardness property in the range of A19 to A30 Shore hardness; the durometer may further range A20-A27 Shore hardness; or A23-A25 Shore hardness. As an example, one elastomeric material is styrene-ethylene/butylene-styrene block copolymer (SEBS) manufactured by GLS Corporation. Nevertheless, SEBS material from other manufacturers or other materials within and outside the noted hardness range could be used. The flexibility of the second tooth cleaning element 110 can be controlled as desired.

Figure 4:
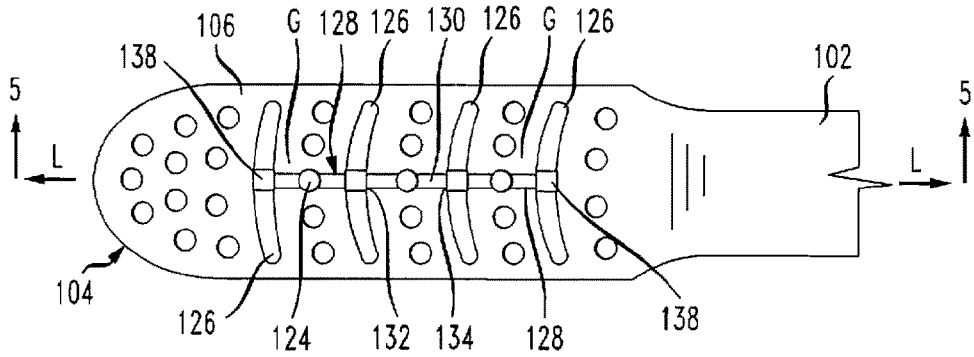
FIG. 4 is a top plan view of the toothbrush of FIG. 2.

In one construction, the second tooth cleaning element 110 generally includes a base 122, a protrusion 124 and an arcuate wall member 126. The base 122 may generally be considered to be in the form of a longitudinal wall member 128. In one embodiment, the base 122 is positioned generally at a central location on the support member 106. The base 122 extends longitudinally generally parallel to the longitudinal axis L of the toothbrush 100 passing through the handle 102 and the head 104. Accordingly, the base 122 is generally in the middle of the support member 106 (FIG. 4). The base 122 has the structure 118 in the form of the element 120 to direct dentifrice applied to the head 104 towards the distal region 116 of the head 104. The element 120 may be a contoured surface, or curvilinear surface, extending towards the distal region 116. In one preferred construction, the structure 118 comprises a concave structure that defines a concave surface 130. The concave surface 130 faces upwards and towards the distal region 116 of the head 104. With such concave structure, a first end 132 and a second end 134 of the concave surface 130 are positioned closer to the distal region 116 of the head 104 than a lowermost segment 136 of the concave surface 130.

As further shown in FIGS. 2-5, the base 122 may have a plurality of concave surfaces 130, and in one preferred construction, the base 122 has three concave surfaces 130. The plurality of concave surfaces 130 are generally aligned and extend along the head 104 generally parallel to the longitudinal axis L of the toothbrush 100. Thus, the plurality of concave surfaces 130 may be considered as being positioned in series relationship, end-to-end along the head 104. Accordingly, one end of the concave surface 130 is adjacent another end of a separate concave surface 130. The concave surfaces 130 could be slightly offset if desired.

The protrusion 124 of the second tooth cleaning element 110 is connected to the base 122. The protrusion 124 is a flexible member. As further shown in FIGS. 2-5, the protrusion 124 extends from the concave surface 130 of the base 122 towards the distal region 116 of the head 104. The protrusion 124 generally has a cylindrical cross-sectional shape although other configurations are possible. The protrusion 124 may extend below the concave surface 130 towards a bottom portion of the base to enhance the overall support of the protrusion 124. The protrusion 124 can vary in height and flexibility. In one construction, the protrusion 124 extends from the lowermost segment 136 of the concave surface 130 and between first end 132 of the concave surface 130 and the second end 134 of the concave surface 130, opposite the first end 132. A distal end of the protrusion 124 is preferably rounded.

As further shown, the protrusion 124 includes a plurality of protrusions 124. Thus, each concave surface 130 has a protrusion 124 extending therefrom. In one preferred embodiment, the second tooth cleaning element includes three protrusions 124.

As further shown in FIGS. 2-5, the second tooth cleaning element 110 also includes the arcuate wall member 126. The arcuate wall member 126 extends from the support member 106 and is a curved structure. The arcuate wall member 126 is curved towards the handle 102. The arcuate wall member extends from the base 122 such that a portion of the arcuate wall member 126 extends from each side of the base 122. The arcuate wall member 126 has a protuberance 138 extending from a top surface of the arcuate wall member 126.

In one construction, the arcuate wall member 126 includes a plurality of arcuate wall members 126 extending from the support member 106 and positioned along the base 122. Accordingly, one construction of the toothbrush includes four arcuate wall members 126. It is understood, however, that more or less arcuate wall members 126 could be utilized. For example, a pair of arcuate wall members 126 could be used wherein an arcuate wall member 126 is positioned at each end of the base 122. The number of arcuate wall members 126 utilized could also depend on the number of concave surfaces utilized wherein an arcuate wall member 126 is positioned between adjacent ends of the concave surfaces 130.

An arcuate wall member 126 is positioned at each end of the base 122 and an arcuate wall member 126 is positioned between the concave surfaces 130 at intermediate positions on the base 122. For each concave surface 130, one arcuate wall member 126 extends from the base 122 at one end 132 of the concave surface 130 and a second arcuate wall member 126 extends from the base 122 and is spaced from the other arcuate wall member 126 at a second end 134 of the concave surface 130. The projection 124 extends from the concave surface 130 towards the distal region 116 wherein gaps G are defined between the protrusion 124 and the arcuate wall members 126. This structure is repeated along the base 122. The gaps G may also be defined between the protrusion 124 and the ends 132,134 of the concave surface 130.

Figure 2:
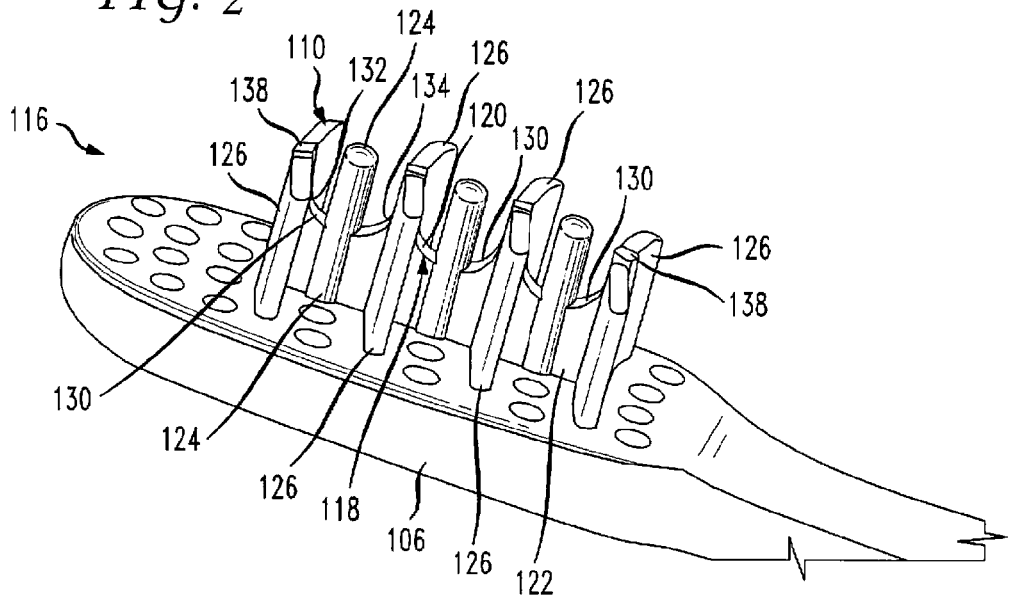
FIG. 2 is another perspective view of the toothbrush of FIG. 1 having tooth cleaning elements in the form of bristles removed for clarity.
Figure 3:
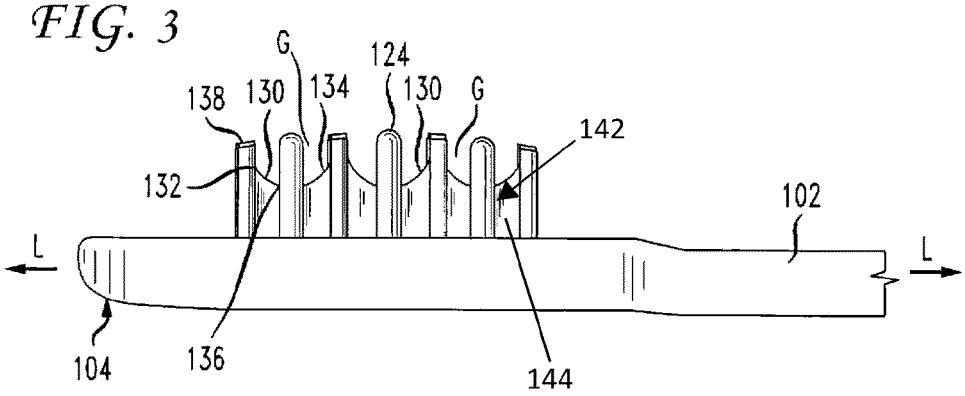
FIG. 3 is a side view of the toothbrush of FIG. 2.

As previously discussed with respect to FIGS. 2-4, the cylindrical structure of the protrusion 124 extends downwards from the lowermost segment 136 of the concave surface 130 to the connection interface between the base 122 and the support member 106. As shown in FIGS. 3 and 4, the cylindrical structure of the protrusion 124 extends beyond the base 122 providing a crease 142 that extends vertically on the base 122. The crease 142, in cooperation with a portion of the arcuate wall member 126 and the portion of the base 122 extending therebetween, defines a wide channel 144. The channel 144 extends from a top surface of the support member 106 to the concave surface 130. The channel 144 can also assist in directing dentifrice and fluids towards the distal end 116 of the head 104. It is understood that the wide channels 144 are defined at multiple locations on the second tooth cleaning element 110.

As previously discussed, the bristles 112 are generally positioned about the second tooth cleaning element 110. This includes positioning the bristles 112 between the arcuate wall members 126 and adjacent the base 122 and protrusions 124. The bristles 112 may completely surround the second tooth cleaning element 110.

It is understood that the concave surface 130, the protrusion 124 and the arcuate wall members 126 cooperatively form a receiver 140. The receiver 140 is adapted to receive dentifrice applied to the head 104. These structures cooperate to better hold and retain dentifrice so that the dentifrice can be more efficiently applied to tooth surfaces. Furthermore, the concave surfaces 130 assist in directing dentifrice towards the distal region 116 so that the dentifrice can be more efficiently applied to tooth surfaces during brushing. Accordingly, as can be appreciated from FIGS. 1 and 5, when an amount of dentifrice is applied to the toothbrush 100, the dentifrice is supported by the head 104 and received by the receiver 140. When a user brushes with the toothbrush 100, dentifrice and associated fluids are moved about the head 104 and onto tooth and gum surfaces.

With the structure of the tooth cleaning elements 108,110, retention of dentifrice on the head 104 is improved. As can be appreciated from FIG. 5, the concave surfaces 130 act to direct and channel the fluids toward the distal region 116 of the head 104 as schematically represented by arrows A. The curved aspects of the concave surfaces 130 enhance this directing ability as opposed to other less contoured structures that may allow dentifrice to stagnate on the head 104. In addition, the protrusions 124 help retain dentifrice and further engage tooth surfaces wherein these flexible members provide further cleaning actions. The wide channels 144 also assist in directing dentifrice towards the distal region 116. The protuberances 138 on the arcuate wall members 126 provide additional cleaning structures that can engage tooth and gum surfaces. These structures enhance the tooth whitening and overall cleaning capabilities of the toothbrush 100.

Figure 6:
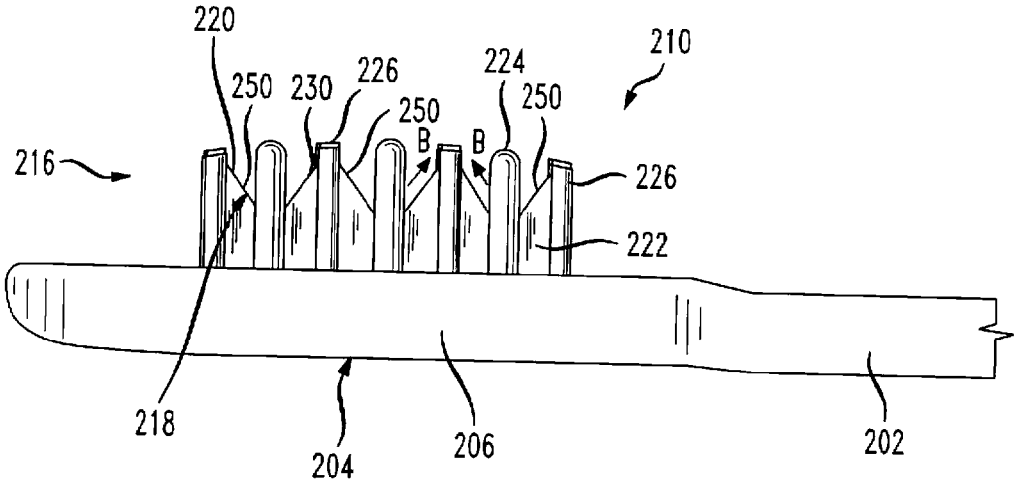
FIG. 6 is a side view of an alternative embodiment of the toothbrush of the present invention.

FIG. 6 discloses an alternative embodiment of the oral care implement, or toothbrush, of the present invention, generally designated with the reference numeral 200. Similar structures will be referred to with similar reference numerals, only using a 200 series numeral. The head 204 includes the second tooth cleaning element 210 that has a structure 218 in the form of an element 220 that extends towards the distal region 216. In this construction, the structure is generally a v-shaped element. Thus, while the toothbrush 100 of FIGS. 1-5 has a concave surface 130, the toothbrush 200 of FIG. 6 has inclined surfaces 250. The inclined surfaces 250 extend upwardly from either side of the protrusion 224. The protrusion 224 may be considered to extend within a cooperating pair of inclined surfaces 250. The angle at which the inclined surfaces 250 extend towards the distal region 216 can vary as desired. The inclined structures 250 provide similar benefits as discussed above regarding better retention and direction of dentifrice applied to the head 204. The inclined surfaces 250 act to direct and channel the dentifrice and other fluids toward the distal region 116 of the head 204 as schematically represented by arrows B. It is understood that the toothbrush 200 of FIG. 6 also has the other structures discussed above and also provides similar benefits as previously described.

The toothbrushes 100, 200 can be formed using a variety of manufacturing processes. Components of the toothbrushes 100, 200 can be individually formed and subsequently connected. The toothbrush 100, 200 is particularly suitable for cleaning elements in the form of strands or bristles attached via anchor free tufting (AFT). In the AFT toothbrush brush making process, described in detail in U.S. Pat. No. 6,779,851, nylon is fed into a pre-molded plate that can be made from any thermoplastic or elastomer material or combination thereof. This nylon may be processed into bristle tufts of various sizes and shapes. The non-use or proximal end of the nylon is heated and melted to retain the nylon in the brush head. The head plate may then be ultrasonically welded to a pre-molded handle that has a peripheral wall or frame on which the head plate will rest and become fused to the handle. In other methods, the head can be formed having an opening wherein the tooth cleaning elements are injection-molded in a further process step through the opening in the head. The second tooth cleaning element can also be pre-molded and then sonically-welded to the head. Other suitable manufacturing processes can also be utilized.

The inventive aspects may be practiced for a manual toothbrush or a powered toothbrush. In operation, the previously described features, individually and/or in any combination, improves cleaning performance of toothbrushes. These advantages are also achieved by the cleaning elements and the synergistic effects. While the various features of the toothbrush 100 work together to achieve the advantages previously described, it is recognized that individual features and subcombinations of these features can be used to obtain some of the aforementioned advantages without the necessity to adopt all of these features. This unique combination of elements improves and enhances cleaning and teeth whitening performance of toothbrushes. It is understood that designations such as "first" and "second" are for illustrative purposes and can be interchanged.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

I claim:

1. An oral care implement, comprising:

a head having a support member having a longitudinal axis;

a tooth cleaning element extending from the support member of the head and comprising:

a first transverse wall member having a top surface;

a second transverse wall member spaced from the first transverse wall member and having a top surface;

a longitudinal wall member extending between and connecting the first and second transverse wall members, the longitudinal wall member having a top surface that extends from a first end to a second end, the top surface of the longitudinal wall member having a lowermost portion positioned between the first end and the second end;

the first end of the top surface of the longitudinal wall member located at a first side of the first transverse wall member below the top surface of the first transverse wall member, the first transverse wall member extending upward from the first end of the top surface of the longitudinal wall member;

the second end of the top surface of the longitudinal wall member located at a first side of the second transverse wall member below the top surface of the second transverse wall member, the second transverse wall member extending upward from the second end of the top surface of the longitudinal wall member; and a protrusion extending upwardly from the lowermost portion of the top surface of the longitudinal wall member and downwardly from the lowermost portion of the top surface of the longitudinal wall member.

2. The oral care implement of claim 1, wherein the first and second transverse wall members are arcuate.

3. The oral care implement of claim 2, further comprising a handle coupled to the head and wherein the first and second transverse wall members are curved towards the handle.

4. The oral care implement of claim 1, further comprising a plurality of tufts of bristles disposed between the first and second transverse wall members.

5. The oral care implement of claim 1, wherein the top surface of the longitudinal wall member is concave.

6. The oral care implement of claim 1, further comprising a third transverse wall member spaced from the first and second transverse wall members and having a top surface and a second longitudinal wall member extending between and connected to the second and third transverse wall members.

7. The oral care implement of claim 6, further comprising:

the second longitudinal wall member having a top surface that extends from a first end to a second end, the top surface of the second longitudinal wall member having a lowermost portion positioned between the first end and the second end;

the first end of the top surface of the second longitudinal wall member located at a second side of the second transverse wall member below the top surface of the second transverse wall member, the second transverse wall member extending upward from the first end of the top surface of the second longitudinal wall member; and the second end of the top surface of the second longitudinal wall member located at a side of the third transverse wall member below the top surface of the third transverse wall member, the third transverse wall member extending upward from the second end of the top surface of the second longitudinal wall member.

8. The oral care implement of claim 1, wherein the protrusion has a generally cylindrical cross-sectional shape.

9. The oral care implement of claim 8, wherein the protrusion protrudes laterally from opposing sides of the longitudinal wall member so as to create first and second creases on the longitudinal wall member.

10. The oral care implement of claim 9, further comprising a first channel formed by a portion of the longitudinal wall member located between the first crease and the first transverse wall member and a second channel formed by a portion of the longitudinal wall member located between the second crease and the second transverse wall member.

11. The oral care implement of claim 10, wherein each of the first and second channels extend from the support member of the head to the top surface of the longitudinal wall member.

12. The oral care implement of claim 1, further comprising a protuberance extending upwardly from the top surface of each of the first and second transverse walls, the protuberances generally aligned along the longitudinal axis.

13. The oral care implement of claim 1, wherein a distal end of the protrusion is rounded.

14. The oral care implement of claim 13, further comprising a protuberance having a distal end extending upwardly from the top surface of each of the first and second transverse walls.

15. The oral care implement of claim 14, wherein a cleaning surface formed by the distal end of the protrusion is convex.

16. The oral care implement of claim 1, wherein the tooth cleaning element is a thermoplastic elastomer member.

17. The oral care implement of claim 1, further comprising a second tooth cleaning element comprising a plurality of bristles connected to the head and positioned about the first tooth cleaning element.

18. The oral care implement of claim 1, wherein the top surface of the longitudinal wall member has a first inclined surface extending from the lowermost portion of the longitudinal wall member to the first end of the longitudinal wall member and a second inclined surface extending from the lowermost portion of the longitudinal wall member to the second end of the longitudinal wall member.

19. An oral care implement, comprising:

a head having a support member having a longitudinal axis;

a tooth cleaning element extending from the support member of the head and comprising:

a longitudinal wall member connected to the support member, the longitudinal wall member extending generally along the longitudinal axis of the head, the longitudinal wall member having a concave top surface extending from a first end to a second end;

a first arcuate wall member extending transversely from each side of the longitudinal wall member at the first end;

a second arcuate wall member extending transversely from each side of the longitudinal wall member at the second end;

wherein the first and second arcuate wall members extend a first distance from the support member and the first and second ends of the concave top surface of the longitudinal wall member being located at a second distance from the support member, the first distance being greater than the second distance; and wherein a lowermost portion of the concave top surface of the longitudinal wall member is positioned between the first and second ends of the concave top surface and a protrusion extends downwardly from the lowermost portion of the concave top surface.

20. The oral care implement of claim 19, wherein the protrusion extends upwardly from the lowermost portion of the concave top surface.

21. The oral care implement of claim 19, further comprising a handle coupled to the head and wherein the first and second arcuate wall members are curved towards the handle.

22. The oral care implement of claim 19, wherein each of the first and second arcuate wall members has a protuberance extending therefrom.

23. The oral care implement of claim 22, wherein each of the protuberances are positioned at a central location on the arcuate wall members generally aligned with the longitudinal axis of the head.

24. The oral care implement of claim 19, wherein the first arcuate wall member is longitudinally spaced from the second arcuate wall member.

25. The oral care implement of claim 24, wherein gaps are defined between the protrusion and each of the first and second arcuate wall members.

26. The oral care implement of claim 19, wherein the tooth cleaning element is a thermoplastic elastomer member.

27. The oral care implement of claim 19, wherein the concave top surface of the longitudinal wall member comprises a plurality of concavities generally longitudinally aligned, each of the concavities extending from a first end to a second end and having a lowermost portion positioned between the first and second ends.

28. The oral care implement of claim 27, further comprising a cylindrical protrusion extending upwardly from the lowermost portion of each of the concavities of the concave top surface of the longitudinal wall member.

29. The oral care implement of claim 28, further comprising an arcuate wall member extending transversely from the longitudinal wall member at each of the first and second ends of each of the concavities.

30. The oral care implement of claim 29, wherein each of the arcuate wall members has a top surface comprising a protuberance extending upwardly therefrom, the protuberances of the arcuate wall members generally aligned along the longitudinal axis.

31. The oral care implement of claim 19, further comprising a second tooth cleaning element comprising a plurality of bristles connected to the support member and positioned about the tooth cleaning element.

* * * * *